350-334 SR
PM012 XR 4,234,947

United States Patent [19]
Matsumoto

[11] 4,234,947
[45] Nov. 18, 1980

[54] SOLAR BATTERY POWERED TIMEPIECE

[75] Inventor: Masataka Matsumoto, Tokorozawa, Japan

[73] Assignee: Citizen Watch Co., Ltd., Tokyo, Japan

[21] Appl. No.: 968,688

[22] Filed: Dec. 13, 1978

[30] Foreign Application Priority Data

Dec. 22, 1977 [JP] Japan ..... 52/171788[U]
Jan. 12, 1978 [JP] Japan ..... 53/2429[U]

[51] Int. Cl.[3] ..... G04B 37/00
[52] U.S. Cl. ..... 368/287; 368/294; 368/314; 368/64; 368/205
[58] Field of Search ..... 58/23 R, 50 R, 91, 90 R, 58/88 R, 23 BA, 88 C

[56] References Cited

U.S. PATENT DOCUMENTS

| | | | |
|---|---|---|---|
| 3,427,797 | 2/1969 | Kimura et al. | 58/23 BA |
| 3,757,511 | 9/1973 | Burgess et al. | 58/50 R |
| 3,780,519 | 12/1973 | Tokunaga | 58/50 R X |
| 4,048,796 | 9/1977 | Sasaki | 58/50 R X |

FOREIGN PATENT DOCUMENTS

| | | | |
|---|---|---|---|
| 2553015 | 6/1977 | Fed. Rep. of Germany | 58/23 BA |

*Primary Examiner*—Ulysses Weldon
*Attorney, Agent, or Firm*—Holman & Stern

[57] ABSTRACT

A solar battery powered electronic timepiece of the type wherein a watch glass and a base plate supporting a solar battery are secured in an annular recess in a watch case. The base plate is positioned on a bottom surface of the recess and secured in position by a resilient packing which is preferably made from a resin material. The packing extends around the base plate and has a portion which overlines the outer periphery of the base plate and on which is positioned the watch glass. Another portion of the packing extends between the outer periphery of the watch glass and a side wall of the recess to secure the watch glass in position. A structure of this type is particularly suitable for securing a base plate of a material such as epoxy resin to which fastening legs cannot easily be attached.

9 Claims, 12 Drawing Figures

SOLAR BATTERY POWERED TIMEPIECE

TECHNICAL FIELD

This invention relates to electronic timepieces and in particular to a structure for securing a watch glass and the base plate of a solar battery in a timepiece which utilizes a battery of this type.

BACKGROUND ART

Some electronic timepieces generally employ as a power source a miniature battery such as a silver oxide cell. As these batteries have a lifetime of one or two years it has been necessary to periodically replace them. In order to preclude this troublesome replacement of batteries, timepieces utilizing solar batteries have been developed and put into practical use. These solar batteries which are semi-permanent in nature convert light energy into electrical energy and are used to charge the power source battery so that it need not be replaced. However, recent years have seen the development and partial marketing of timepieces with circuitry designed to reduce greatly the power consumption. This has made it possible to attain a battery lifetime of as much as 5 years although placing something of a restriction on the timepiece mechanism and battery configuration. A timepiece in which a battery has a 5-year lifetime can therefore be utilized for 10 years by exchanging the battery only once. The end of this 10-year period is considered to represent the end to the lifetime of the timepiece since a timepiece is usually lost or damaged during this interval. In view of this fact, equipping a timepiece with a solar battery complicates the circuitry and construction and hence raises the cost without providing any particularly outstanding advantage. Nevertheless, a solar battery is essential for multi-function digital timepieces and can be effectively used in the future. Specifically, since the illumination lamp and such additional functions as an alarm function in multi-function digital watches consume a considerable amount of power, there is still a requirement for solar batteries in order to ensure extended power source lifetime.

It has heretofore been common practice to solder a plurality of silicon solar batteries in series onto the electrode pattern of a flexible polymide sheet provided with printed wiring and to paste the flexible sheet onto a metal base plate. In order to secure the conventional solar battery base plate it was also ordinary practice to braze legs to the bottom surface of the metal base plate and insert the legs into a module and then secure them with screws. However, in order to reinforce the flexible sheet and straighten its curvature it was necessary to paste the sheet onto a plate such as the metal plate. Accordingly, there was an increase in the number of component parts and in the number of bonding steps.

Attempts have recently been made to reduce the cost of manufacturing these solar battery base plates by forming the printed wiring directly on a glass epoxy resin and then soldering the solar batteries onto the printed wiring. The glass epoxy resin therefore serves as the base plate. However, since legs cannot be brazed onto a glass epoxy resin base plate as they can in the case of the metal base plate, another method of fixing the base plate is required.

It is therefore an object of the present invention to provide a structure for securing a solar battery base plate made of a material such as glass epoxy resin to which legs cannot be attached.

DISCLOSURE OF INVENTION

The present invention provides an electronic timepiece wherein a base plate for a solar battery and a watch glass are secured in an annular recess in a watch case, said recess having a bottom surface and a peripheral side wall, wherein the base plate is placed on the bottom surface of the recess and secured in position by a resilient packing extending around the base plate having in cross-section a portion extending between the said side wall and the outer periphery of the base plate, a portion at right angles thereto to support the said watch glass at its periphery and extending between the said watch glass and an opposed surface of the base plate, and a portion extending between the said side wall and the outer periphery of the watch glass.

DETAILED DESCRIPTION OF DRAWINGS

Figure 1:
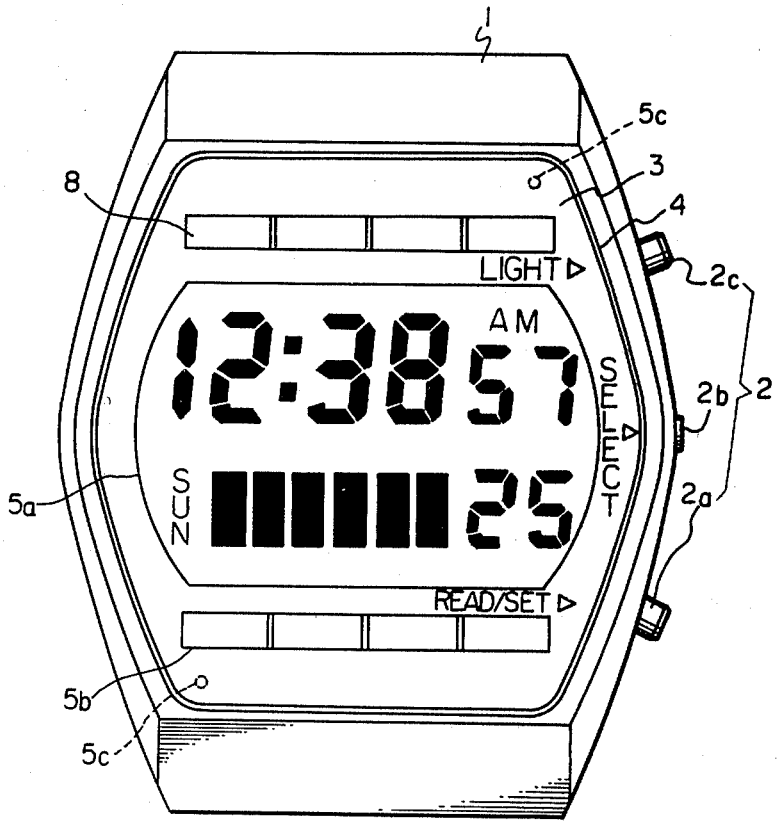
FIG. 1 is a plan view of a solar battery-equipped watch in accordance with the invention.

Referring first to FIG. 1 reference numeral 1 denotes a watch case, 2 designates push buttons, 3 a watch glass and 4 a packing. Push button *2a* changes over and corrects the display, push button *2b* selects the digits which are to be corrected, and push button *2c* ignites an illumination lamp. The display shows a calendar date of Sunday, the 25th day of the month, and a time of 12:38:57 A.M.

Figure 2:
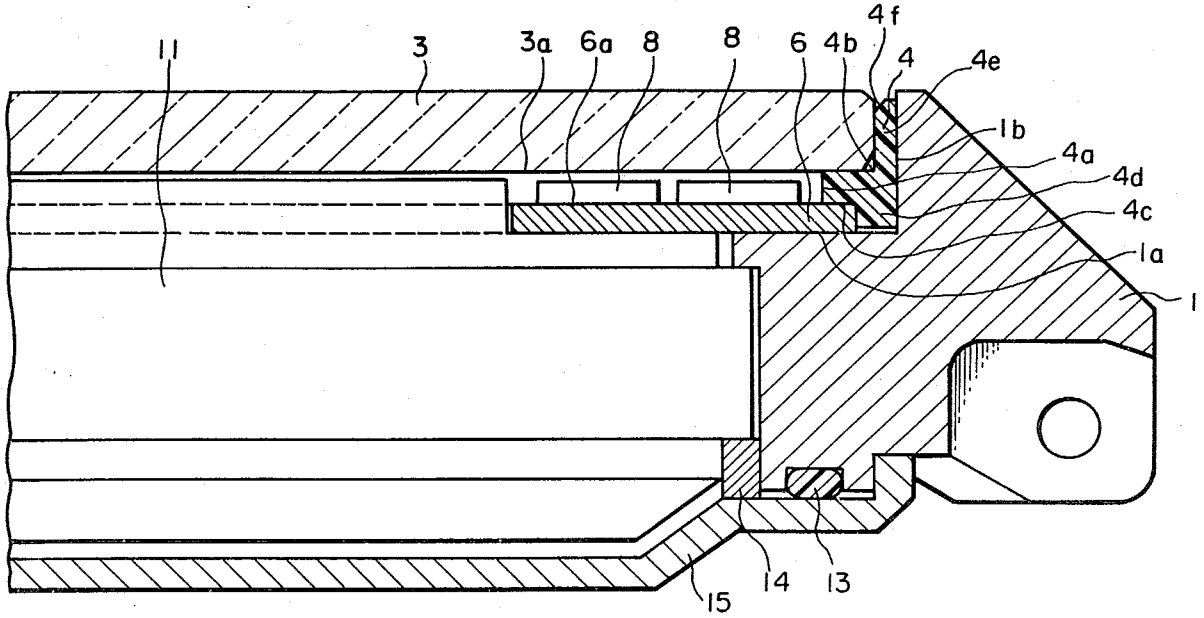
FIG. 2 is a cross-sectional view through the watch of FIG. 1, showing the securing means used in the invention.
Figure 3:
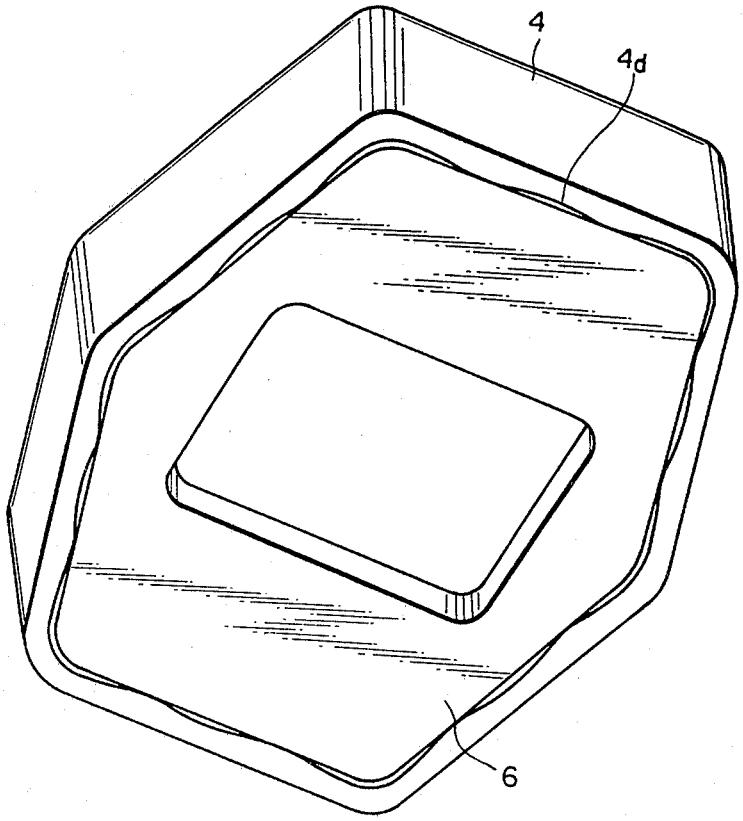
FIG. 3 is a perspective view from below of the packing and battery base plate of the watch of FIG. 1.

Referring now to FIGS. 2 and 3, a solar battery base plate 6 made of glass epoxy resin has a wiring pattern *6a* disposed on its top surface, and a recess *6c* at a central portion thereof to accommodate therein a electro-optical display cell 16. The base plate 6 is disposed on the bottom surface *1a* of a recess in a watch case 1. A plurality of silicon solar batteries 8 are attached in series to a prescribed portion of the wiring pattern *6a* by means of soldering. A watch glass 3 having a printed partition *3a* formed on its bottom surface also has its edges planed off. A resin packing 4 for securing solar battery base plate 6 and watch glass 3 in the recess of the watch case 1 has a collar portion *4a* about its inner periphery which extends between watch glass and base plate 6, spacing them apart. On opposite sides of collar portion *4a* are respective stepped recesses *4b*, *4c* of L-shaped cross-section. The side surface of recess 4c, on a portion 4d of the packing extending between the outer periphery of the base plate 6 and a sidewall 1b of the recess, has a wave-like contour. The watch case 1 accommodates a module 11.

The periphery of the base plate 6 is embraced by the wave-like surface of portion 4d of the packing. Since the collar portion 4a of the packing rests on an outer peripheral portion of base plate 6, press fitting watch glass 3 into the recess in watch case 1 through the intermediary of packing 4 allows the base plate to be depressed and secured by the collar portion 4a and to resiliently retain the base plate to alleviate external shocks being applied to the base plate in an axial direction. In other words, solar battery base plate 6 is restrainably set within stepped recess 4c of the packing and watch glass 3 is press fitted into the stepped recess 4b.

Thus, the solar battery base plate is fixed essentially as follows. First, base plate 6 is placed on the bottom surface 1a of the recess in watch case 1. Next, packing 4 is disposed on the surface 1a such that the wave-like surface of portion 4d of the packing embraces the peripheral surface of the base plate to resiliently retain the base plate to alleviate the external shocks being applied to the base plate in its radial direction. Watch glass 3 is then secured by press fitting it down into stepped portion 4b of the packing, whereby a portion 4e of packing 4 is strongly compressed between the side surface of watch glass 3 and the sidewall 1b of the recess in watch case 1. This simultaneously assures a water-tight seal and allows collar portion 4a to pressure and thus secure solar battery base plate 6. The introduction of the watch glass can be facilitated by planing off the edge along the inner periphery of packing 4 as shown at 4b. Module 11 is inserted into the watch case 1 from below and can be electrically connected through the use of spring contact or an electrically conductive rubber, as will be described in connection with FIG. 5.

Figure 4:
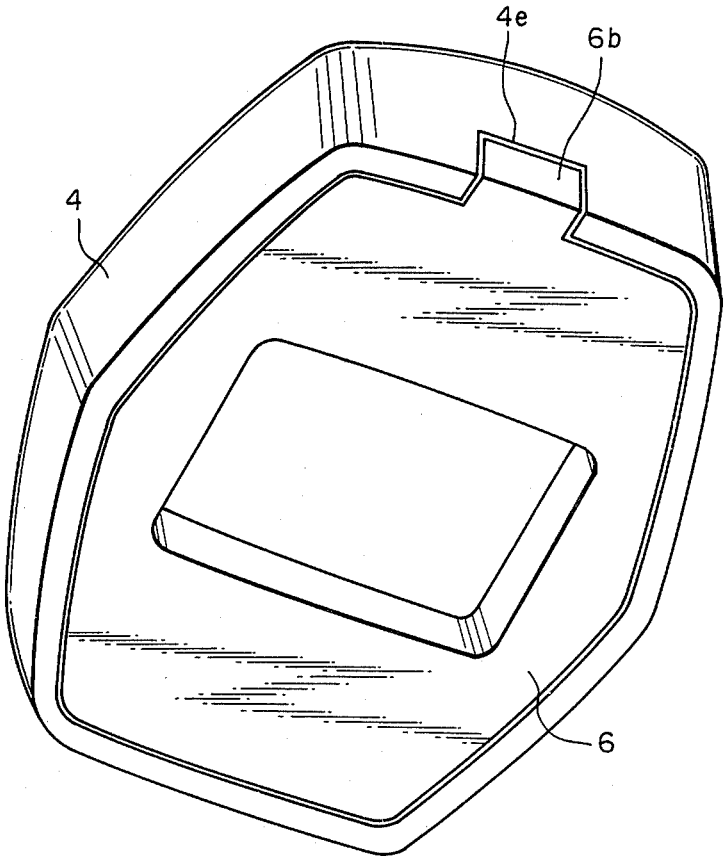
FIG. 4 is a view similar to that of FIG. 3, showing an alternative embodiment.

FIG. 4 depicts another embodiment of the present invention. Here, a projection 6b is provided on the outer periphery of solar battery base plate 1 and engaged with a recess 4e formed in the bottom part of packing 4, thereby allowing the base plate to be positioned. Alternatively, it is possible to provide the projection on the packing and the recess in the base plate.

In accordance with the foregoing construction, it is now possible to secure a legless base plate made of glass epoxy resin or the like by making use of a packing. The cost of manufacturing timepieces can therefore be reduced since assembly is simplified by the fact that the base plate need not be provided with legs. Displacement of the base plate due to impact is prevented since the outer edge of the plate is embraced by the packing. Furthermore, the collar portion 4a of the packing also serves as a spacer which forms a gap between the watch glass and base plate so that the watch glass will not strike and damage the solar batteries.

Figure 5:
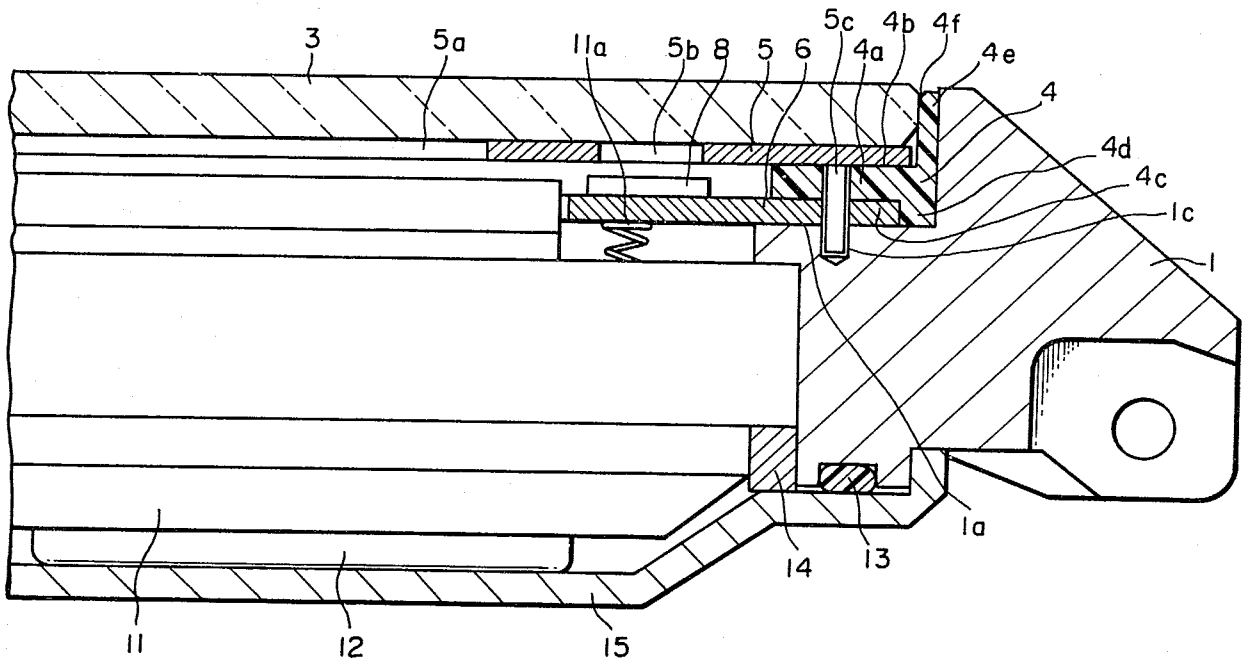
FIG. 5 is a cross-sectional view similar to that of FIG. 2, showing a further embodiment.
Figure 6:
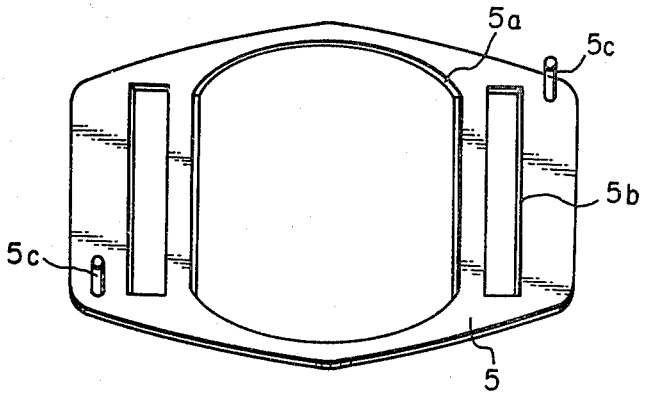
FIG. 6 is a perspective view of a partition plate as used in the embodiment of FIG. 5, FIGS. *7a*, *7b* and *7c* are respectively top, bottom and side views of the battery base plate of the embodiment of FIG. 5.

FIG. 5 is a cross-sectional view showing a principal portion of the timepiece in accordance with another embodiment. Reference numeral 5 denotes a partition plate having a time display window 5a and a solar battery window 5b. Brazed to the bottom surface of partition plate 5 at the corners thereof are two legs 5c, as can be clearly seen in FIG. 6. Reference numeral 6 designates a solar battery baseplate similar to that of the first embodiment, the construction of the base plate being shown in greater detail in FIG. 7 in which FIG. 7a is a top view, FIG. 7b a bottom view and FIG. 7c a side view.

Figure 7A:
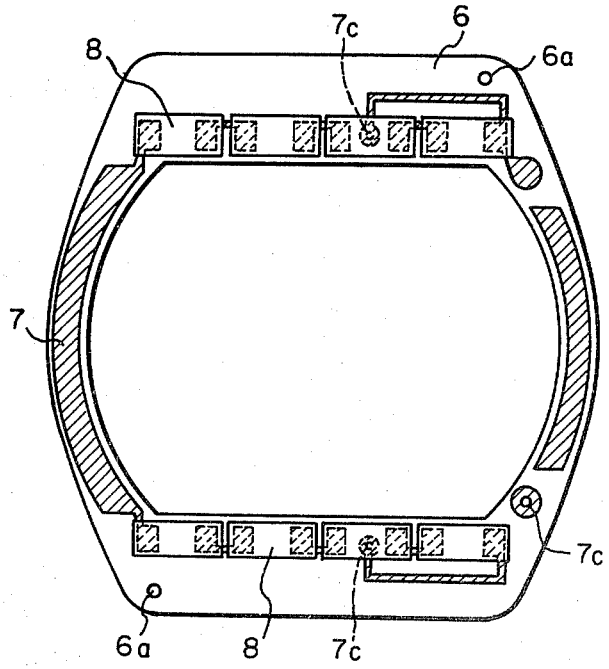
Figure 7B:
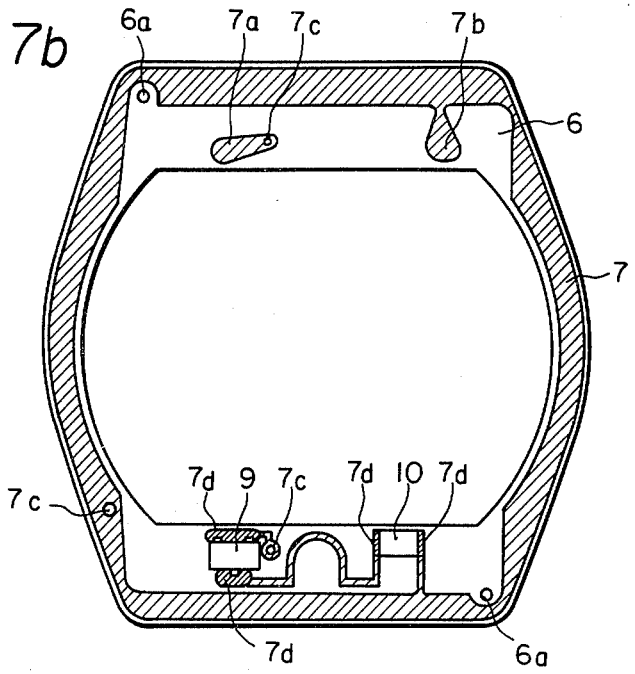
Figure 7C:
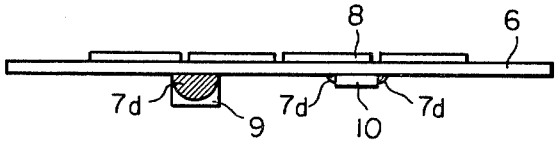
Figure 8:
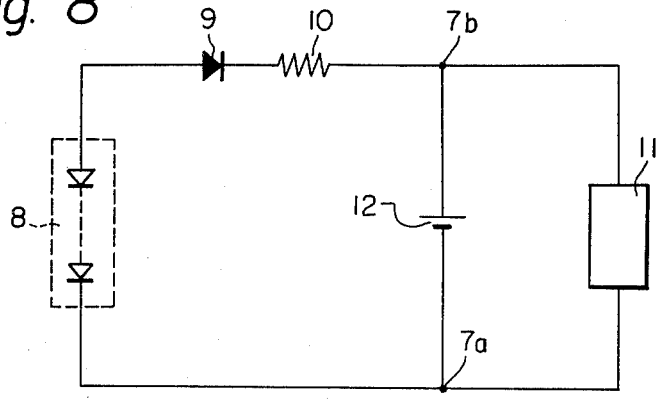
FIG. 8 is a circuit diagram showing how the solar batteries are connected to the watch mechanism.

Referring now to FIGS. 7a to 7c, the top and bottom surfaces of solar battery base plate 6 are provided with wiring patterns having terminal portions 7a, 7b, and top and bottom surfaces being communicated via through-holes 7c. Eight silicon solar batterys 8 are series connected and attached by soldering to prescribed positions on the top surface of base plate 6, and a reverse-current preventing diode and overcharge preventing resistor 10 are similarly series connected and attached by soldering to prescribed positions on the bottom surface of the base plate. Bored through two corners of base plate 6 are positioning holes 6a into which the legs 5c of partition plate 5 are inserted. Module 11 accommodating a miniature battery 12 has two coil springs 11a mounted on its upper portion in order to provide the electrical connection to terminal portions 7a, 7b on base plate 6. This electrical connection is accomplished as shown by the circuit diagram of FIG. 8.

Figure 9:
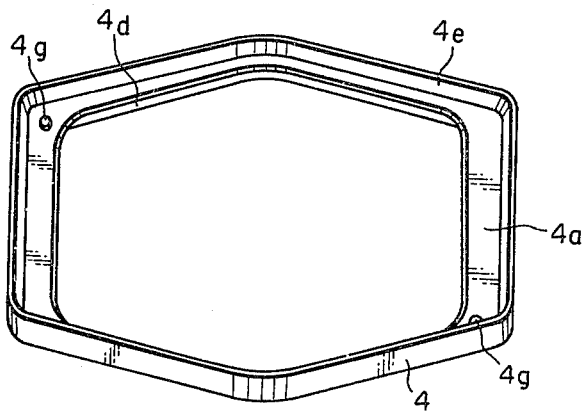
FIG. 9 is a perspective view showing the resin packing of the embodiment of FIG. 5.

FIG. 9 is a perspective view of a resin packing 4. Provided on the inner periphery of the packing is a collar portion 4a which defines stepped recesses 4b, 4c at the top and bottom sides thereof. In other words, an upper portion 4e and lower portion 4d are formed with collar portion 4a acting as a boundary between them. The edge along the inner periphery of upper portion 4d is planed off to form a rounded edge 4f in FIGS. 2 and 5. Bored through two diagonally opposite corners of collar portion 4a are positioning holes 4g through which the legs 5c of partition plate 5 are passed.

Figure 10:
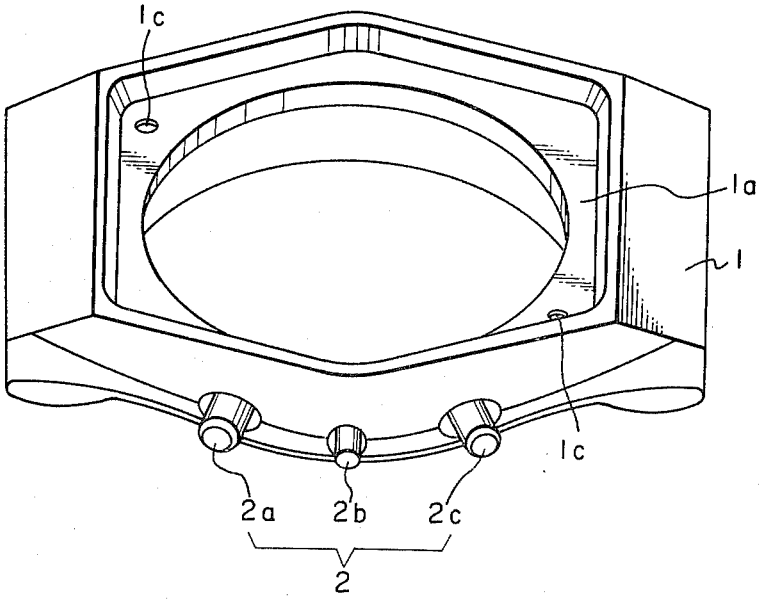
FIG. 10 is a perspective view of the watch case of the embodiment of FIG. 5.

FIG. 10 is a perspective view of watch case 1. Formed on the inner periphery of watch case 1 is a stepped portion 1a for the introduction of the solar battery base plate 6, packing 4, partition plate 5 and watch glass 3. Provided at two corners of stepped portion 1a are positioning holes 1b into which the legs 5c of partition plate 5 are inserted.

Referring once again to FIGS. 2 and 5, reference numeral 13 denotes a waterproofing O-ring, 14 an auxiliary ring made of resin for retaining module 11, and 15 a back cover.

The component parts in FIG. 5 are assembled in the case in the following manner. First, solar battery base plate 6 is placed on stepped portion 1a of watch case 1. Next, packing 4 is placed on base plate 6 such that holes 4g and 6a are in alignment. Base plate 6 is thus accommodated within stepped recess 4c of packing 4 and embraced about its outer periphery by the lower portion 4d of the packing. Partition plate 5 is then placed on stepped recesses 4b of the packing, with the legs 5c being inserted into the aligned holes of watch case 1, solar battery base plate 6 and packing 4. Next, watch glass 3 is press fitted into the watch case from above with the packing 4 interposed therebetween. The packing is thus strongly compressed between the side surface of watch glass 3 and the inner peripheral surface of watch case 1. This assures a water-tight condition and allows stepped recess 4c to pressure and retain base plate 6. The rounded edge 4f of the packing facilitates the introduction of the watch glass, and the collar portion 4a serves as a spacer which forms a gap between base plate 6 and partition plate 5. Module 11, on the other hand, is inserted into the watch case from below and is restrained and secured by back cover 15 through auxiliary ring 14. This brings coil spring 11a into contact with the terminal portion 7a, 7b of solar battery base plate 6 and completes the assembly operation.

Disassembly is accomplished by reversing the procedure.

A solar battery-equipped timepiece having the foregoing construction allows the solar battery base plate 6, packing 4 and partition plate 5 to be positioned and secured in watch case 1 at one time so that each of these three components can be arranged and positioned in good order without risk of displacement. Assembly is simplified and the rigid placement of these components assured by the provision of the positioning holes. Moreover, the utilization of the partition plate greatly adds to the distinctive design of the timepiece.

What is claimed is:

1. An electronic timepiece having an electro-optical display cell, comprising:

a watch case including an recess in one side thereof, said recess having a radially extending bottom surface formed at a lower portion of said recess and a radially facing peripheral wall;

a base plate mounted on the bottom surface of said recess, said base plate supporting at least one solar battery and having a recess at a central portion thereof to accommodate therein said display cell and having a peripheral side wall;

a watch glass positioned in said recess above said base plate and having a bottom wall and a peripheral wall; and resilient packing means including an axially outwardly extending annular wall portion compressed between the peripheral wall of said watch glass and the radially facing peripheral wall of said watch case, a radially inwardly extending annular wall portion compressed between the bottom wall of said watch glass and said base plate to resiliently retain said base plate to alleviate external shocks being applied to said base plate in an axial direction, and an axially inwardly extending annular wall portion compressed between the peripheral wall of said base plate and the peripheral of said watch case to resiliently retain said base plate to alleviate the external shocks being applied to said base plate in its radial direction.

2. An electronic timepiece as claimed in claim 1 wherein said axially inwardly extending portion of said packing means has a radially facing wave-shaped wall engaging the peripheral side wall of said base plate.

3. An electronic timepiece as claimed in claim 1, further comprising a partition plate interposed between the lower surface of said watch glass and an upper surface of the radially extending wall portion of said packing means, said partition plate having a time display window formed at a central portion of said partition plate, and at least one solar battery window formed adjacent said time display window.

4. An electronic timepiece as claimed in claim 1, wherein said base plate is made of epoxy resin.

5. An electronic timepiece as claimed in claim 1, wherein said packing means is made from a resin material.

6. An electronic timepiece comprising:

a watch case having a recess in a side thereof, said recess having a bottom surface and a peripheral side wall;

a base plate supporting at least one solar battery and positioned on said bottom surface of said recess, said base plate having a peripheral projection provided on its outer periphery;

a watch glass positioned in said recess above said base plate; and resilient packing means extending around said base plate and said watch glass, said packing means comprising, in cross-section, a portion extending between said side wall and a peripheral edge of said base plate, a portion at right angles thereto to support said watch glass at its periphery and extending between said watch glass and an opposed surface of the base plate, a portion extending between said side wall and a peripheral edge of said watch glass, and a recess into which said projection of said base plate extends.

7. An electronic timepiece comprising:

a watch case having a recess in a side thereof, said recess having a bottom surface, a peripheral side wall and at least one hole formed at the bottom surface;

a base plate supporting at least one solar battery and positioned on said bottom surface of said recess, said base plate having at least one through-hole aligned with the hole of said watch case;

a watch glass positioned in said recess above said base plate;

resilient packing means extending around said base plate and said watch glass, said packing means comprising, in cross-section, a portion extending between said side wall and a peripheral edge of said base plate, a portion at right angles thereto to support said watch glass at its periphery and extending between said watch glass and an opposed surface of the base plate, a portion extending between said side wall and a peripheral edge of said watch glass, and at least one through-hole aligned with the through-hole of said base plate; and a partition plate inserted between the watch glass and said portion of the packing means which extends between the watch glass and the base plate, and having at least one leg formed on its surface, said leg extending through the aligned holes of said watch case, said base plate and said packing means to secure the base plate and the packing means in a fixed position in said recess.

8. An electronic timepiece comprising:

a watch case having a first recess in one side thereof, said first recess having a bottom surface and a peripheral side wall, said watch case also having a second recess in another side of said watch case;

a base plate supporting at least one solar battery and positioned on said bottom surface of said recess;

a watch glass positioned in said recess above said base plate;

resilient packing means extending around said base plate and said watch glass, said packing means comprising, in cross-section, a portion extending between said side wall and a peripheral edge of said base plate, a portion at right angles thereto to support said watch glass at its periphery and extending between said watch glass and an opposed surface of the base plate and a portion extending between said side wall and a peripheral edge of said watch glass;

a module containing circuitry for the timepiece inserted into the second recess of said watch case;

a resilient member extending between the base plate and the module through an aperture through which the two said recess communicate, said resilient member completing an electrical connection between said solar battery and said module.

9. An electronic timepiece comprising:

a watch case having a first recess in one side thereof, said first recess having a bottom surface and a peripheral side wall, said watch case also having a second recess in another side of said watch case;

a base plate supporting at least one solar battery and positioned on said bottom surface of said recess;

a watch glass positioned in said recess above said base plate;

resilient packing means extending around said base plate and said watch glass, said packing means comprising, in cross-section, a portion extending between said side wall and a peripheral edge of said base plate, a portion at right angles thereto to support said watch glass at its periphery and extending between said watch glass and an opposed surface of the base plate and a portion extending between said side wall and a peripheral edge of said watch glass;

a module containing circuitry for the timepiece inserted into the second recess of said watch case;

a resilient member extending between the base plate and the module through an aperture through which the two said recess communicate, said resilient member being a coil spring, and completing an electrical connection between said solar battery and said module.

* * * * *